US007896977B2

(12) United States Patent
Gillum et al.

(10) Patent No.: US 7,896,977 B2
(45) Date of Patent: Mar. 1, 2011

(54) DISHWASHER WITH SEQUENCING CORNER NOZZLES

(75) Inventors: Bruce W. Gillum, Kalamazoo, MI (US); Donald Joseph Wilson, Stevensville, MI (US); Roger James Bertsch, Stevensville, MI (US); Harshal Jairaj Bhajak, Walchandnager (IN)

(73) Assignee: Whirlpool Corporation, Benton Harbor, MI (US)

( * ) Notice: Subject to any disclaimer, the term of this patent is extended or adjusted under 35 U.S.C. 154(b) by 252 days.

(21) Appl. No.: 11/959,742

(22) Filed: Dec. 19, 2007

(65) Prior Publication Data

US 2009/0159103 A1 Jun. 25, 2009

(51) Int. Cl.
*B08B 3/00* (2006.01)

(52) U.S. Cl. ..... 134/56 D; 134/57 D; 134/58 D

(58) Field of Classification Search ..... None
See application file for complete search history.

(56) References Cited

U.S. PATENT DOCUMENTS

| | | | | |
|---|---|---|---|---|
| 1,720,332 | A | 7/1929 | Kehoe, Jr. | |
| 2,664,902 | A | 1/1954 | Campion | |
| 2,920,633 | A * | 1/1960 | Shepherd | 134/115 G |
| 3,160,164 | A | 12/1964 | Constance et al. | |
| 3,261,554 | A | 7/1966 | Perl | |
| 3,538,927 | A | 11/1970 | Wallgren | |
| 3,847,666 | A * | 11/1974 | Jacobs | 134/57 D |
| 3,876,148 | A | 4/1975 | Cushing et al. | |
| 3,949,772 | A * | 4/1976 | Hartmann | 134/99.1 |
| 4,884,585 | A | 12/1989 | Oh | |
| 5,449,011 | A | 9/1995 | Jacobus et al. | |
| 5,464,482 | A | 11/1995 | Michael et al. | |
| 5,542,443 | A | 8/1996 | Yura et al. | |
| 5,924,432 | A * | 7/1999 | Thies et al. | 134/56 D |
| 6,325,083 | B1 | 12/2001 | Worter | |
| 6,758,227 | B2 | 7/2004 | Lee et al. | |
| 6,795,981 | B2 | 9/2004 | Sato et al. | |
| 6,869,029 | B2 | 3/2005 | Ochoa, Sr. et al. | |
| 2003/0168087 | A1 | 9/2003 | Inui et al. | |
| 2003/0192578 | A1 * | 10/2003 | Ochoa et al. | 134/176 |
| 2004/0255992 | A1 | 12/2004 | Eiermann | |
| 2005/0011544 | A1 | 1/2005 | Rosenbauer et al. | |
| 2006/0197044 | A1 * | 9/2006 | Fortino | 251/129.11 |
| 2006/0278258 | A1 * | 12/2006 | Kara et al. | 134/56 D |

FOREIGN PATENT DOCUMENTS

| | | |
|---|---|---|
| DE | 1962252 | 7/1970 |
| DE | 1628755 | 1/1971 |
| DE | 4020899 A1 * | 1/1992 |
| EP | 0836829 A2 | 4/1998 |

(Continued)

OTHER PUBLICATIONS

Wipperfurth, Franz-Josef, DE 4,020,899, 2/92, Derwent English abstract and English machine translation.*

*Primary Examiner*—Michael Barr
*Assistant Examiner*—Jason Y Ko
(74) *Attorney, Agent, or Firm*—Robert A. Bacon; McGarry Bair, PC

(57) ABSTRACT

An automatic dishwasher having multiple spray nozzles located in the corner of a utensil rack in which case the wash liquid is sequentially sprayed from the corner spray nozzles.

29 Claims, 6 Drawing Sheets

FOREIGN PATENT DOCUMENTS

| | | | |
|---|---|---|---|
| EP | 0943281 | A2 | 9/1999 |
| EP | 1252856 | A2 | 10/2002 |
| GB | 550511 | | 1/1943 |
| WO | 03/053211 | A1 | 7/2003 |
| WO | 2005/065519 | A1 | 7/2005 |

* cited by examiner

DISHWASHER WITH SEQUENCING CORNER NOZZLES

BACKGROUND OF THE INVENTION

Contemporary dishwashers include a tub and an upper and lower rack or basket for supporting soiled utensils within the tub. A pump is provided for re-circulating wash liquid throughout the tub to remove soils from the utensils. The pump normally recirculates the liquid through a rotating spray arm located beneath a rack. One of the problems associated with contemporary dishwashers is that the utensils do not receive uniform wash treatment depending upon their positioning within a rack in the dishwasher. For example, in a typical dishwasher, the racks have a square planform and the rotating spray arms define a circular plane, which does not extend to the corners of the rack, providing the corners of the rack with a lesser wash performance.

SUMMARY OF THE INVENTION

The invention relates to an automatic dishwasher with a wash chamber for receiving utensils to be washed. The wash chamber also houses at least one spray nozzle to spray liquid inside the chamber, a valve selectively operable to fluidly couple the at least one spray nozzle to a liquid supply and a rotating spray arm for introducing liquid into the wash chamber and operably coupled to the valve such that rotation of the spay arm selectively operates the valve to fluidly couple the at least one spray nozzle to the liquid supply.

DESCRIPTION OF EMBODIMENTS OF THE INVENTION

Figure 1:
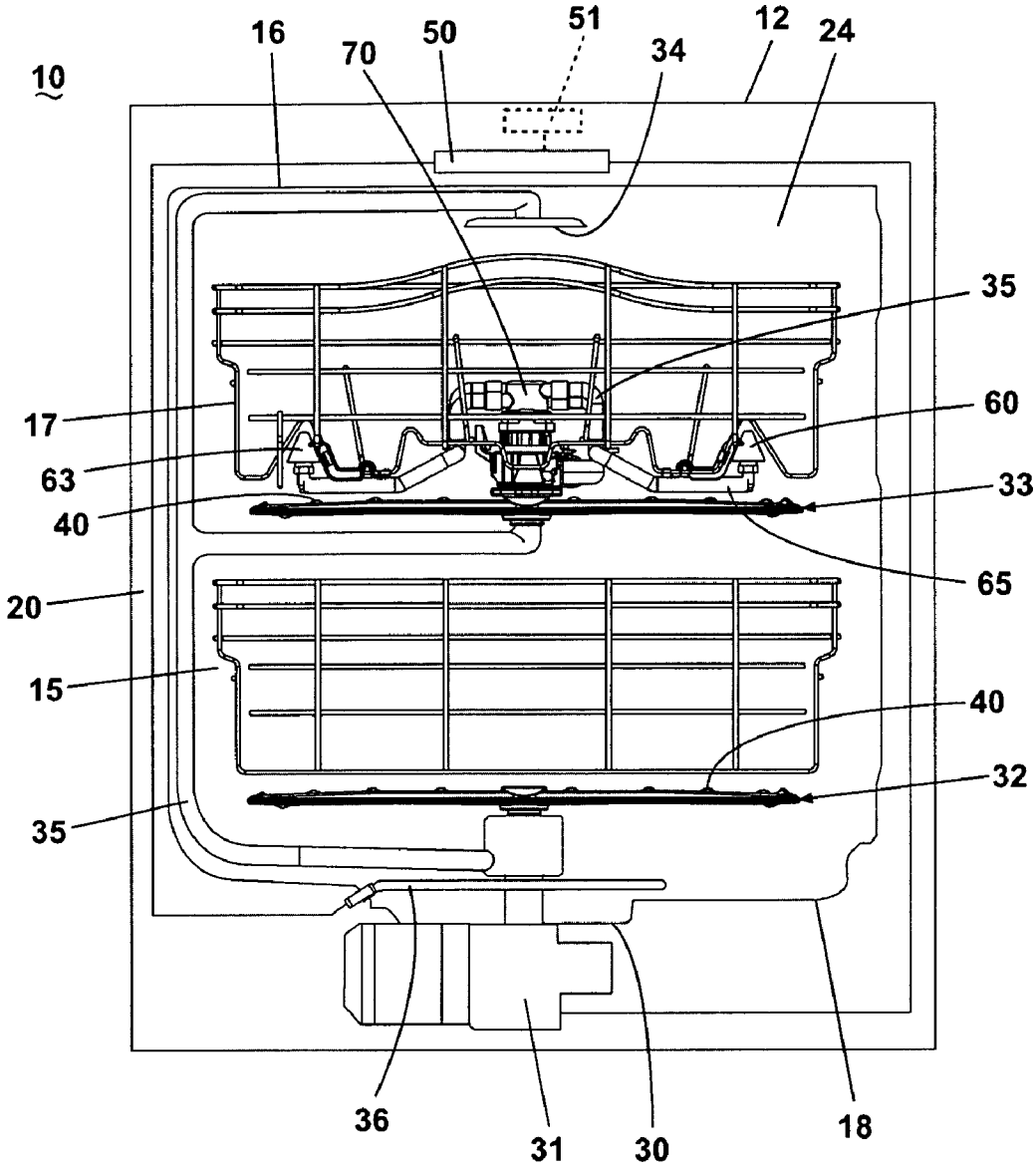
FIG. 1 is a schematic view of a dishwasher according to the invention with wash chamber, upper and lower utensil racks, corner spray nozzles, and a valve.

Referring now to FIG. 1 an embodiment of the invention is illustrated comprising an automated dishwasher 10 having a housing 12. The dishwasher 10 shares many features of a conventional automated dishwasher, which will not be described in detail herein except as necessary for a complete understanding of the invention. The housing 12 has spaced top and bottom walls 16 and 18, and spaced sidewalls 20. The walls 16, 18, and 20 join along their respective edges to define a wash chamber 24. As one of skill in the art will appreciate, the front wall may be the door of the dishwasher 10, which may be pivotally attached to the dishwasher 10 for providing accessibility to the wash chamber 24 for loading and unloading utensils or other washable items. While the present invention is described in terms of a conventional dishwashing unit as illustrated in FIG. 1, it could also be implemented in other types of dishwashing units such as in-sink dishwashers or drawer dishwashers.

Utensil holders in the form of upper and lower utensil racks 15, 17 are located within the wash chamber 24 and receive utensils for washing. The upper and lower racks 15, 17 are typically mounted for slidable movement in and out of the wash chamber 24 for ease of loading and unloading. As used in this description, the term utensil is generic to dishes and the like that are washed in the dishwasher 10 and expressly includes, dishes, plates, bowls, silverware, glassware, stemware, pots, pans, and the like.

The bottom wall 18 of the dishwasher may be sloped to define a lower tub region or sump 30 of the tub. A pump assembly 31 may be located in or around a portion of the bottom wall 18 and in fluid communication with the sump 30 to draw wash liquid from the sump 30 and to pump the liquid to at least a rotating lower spray arm assembly 32. If the dishwasher has a rotating mid-level spray arm assembly 33 and/or an upper spray arm assembly 34, liquid may be simultaneously or selectively pumped through a supply tube 35 to each of the assemblies for selective washing.

In this embodiment, the rotating lower spray arm assembly 32 is positioned beneath a lower utensil rack 15, the rotating mid-level spray arm assembly 33 is positioned between an upper utensil rack 17 and the lower utensil rack 15, and the upper spray arm assembly 34 is positioned above the upper utensil rack 17. The rotating lower spray arm assembly 32 is configured to rotate in the tub and spray a flow of wash liquid from at least one outlet 40, in a generally upward direction, over a portion of the interior of the tub. The spray from the rotating lower spray arm assembly 32 is typically directed to wash utensils located in the lower utensil rack 15. Like the rotating lower spray arm assembly 32, the rotating mid-level spray arm assembly 33 may also be configured to rotate in the dishwasher 10 and spray a flow of wash liquid from at least one outlet 40, in a generally upward direction, over a portion of the interior of the tub. In this case, the spray from the rotating mid-level spray arm assembly 33 is directed to utensils in the upper utensil rack 17. In contrast, the upper spray arm assembly 34 generally directs a spray of wash liquid in a generally downward direction and helps wash utensils on both upper and lower utensil racks 15, 17. The wash liquid may be water, a wash aid or any combination there of. Examples of common wash aids include: a detergent, a spot reducer, a rinse agent, a stain remover, bleach, or any other similar product that facilitates excellent cleaning of the utensils.

The pump assembly 31, spray arm assemblies 32-34 and supply tube 35 collectively form a liquid recirculation system for spraying wash liquid within the wash chamber 24. The pump draws liquid from the sump 30 and delivers it to one or more of the spray arm assemblies 32-34 through the supply tube 35, where the liquid is sprayed back into the wash chamber 24 through the spray arm assemblies 32-34 and drains back to the sump 30 where the process is repeated.

A heater 36 is located within the sump for heating the wash liquid contained in the sump. A controller 50 is operably coupled to the pump assembly 31 and heater 36 and controls the operation of the pump assembly 31 and heater 36 to implement the selected cycle. The controller 50 may comprise a user interface enabling the user to select the desired wash cycle and set correspondingly relevant parameters or options for the cycle. A control panel 51, shown in phantom, may be coupled to the controller 50 and may provide for input/output to/from the controller 50. The control panel may be any suitable input/output device, such as a touch panel, switches, knobs, displays, indicators, etc., and any combination thereof.

Figure 2:
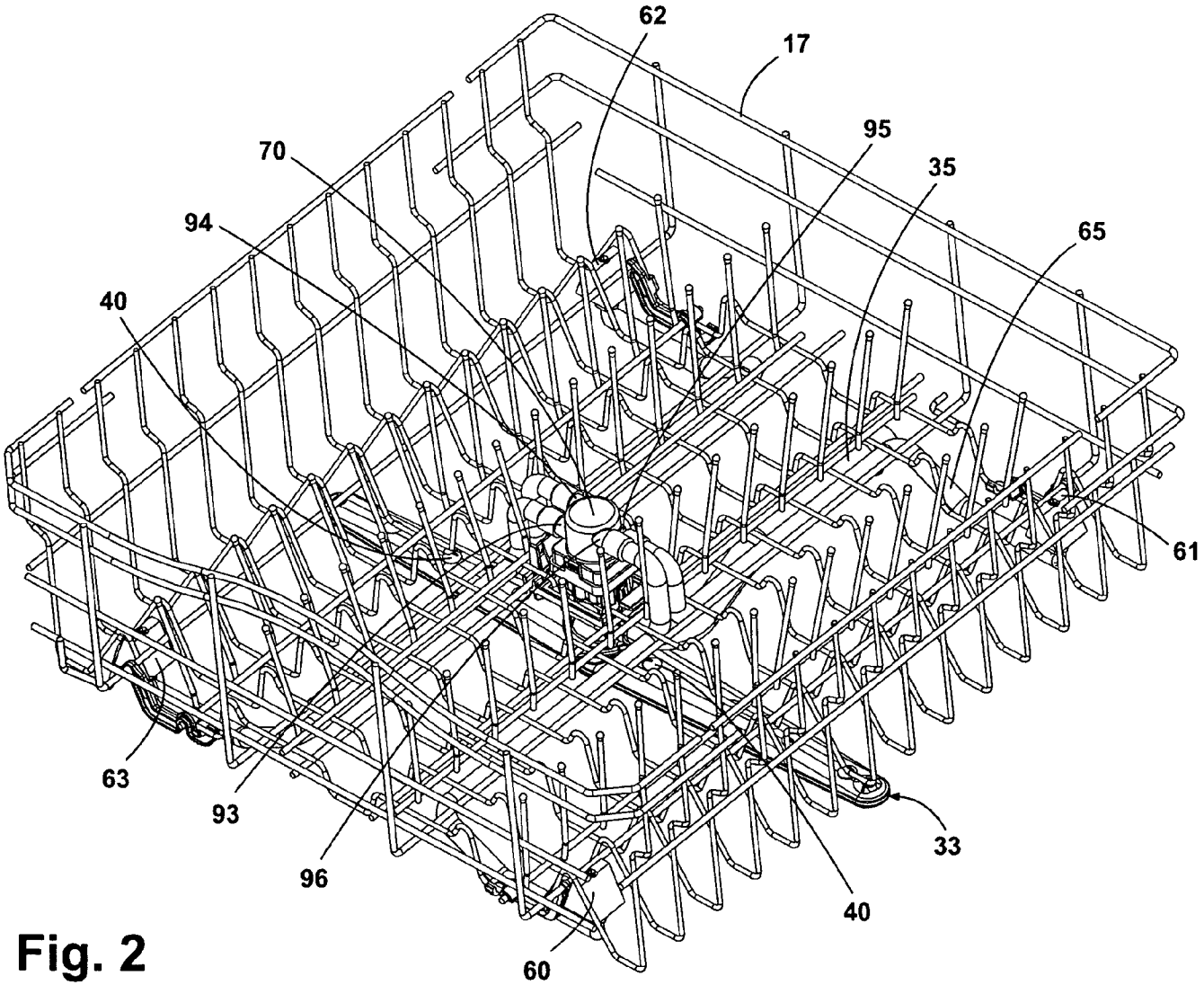
FIG. 2 is a top view of a second embodiment of the invention showing the upper utensil rack, upper rotating spray arm, corner spray nozzles, and valve.
Figure 2A:
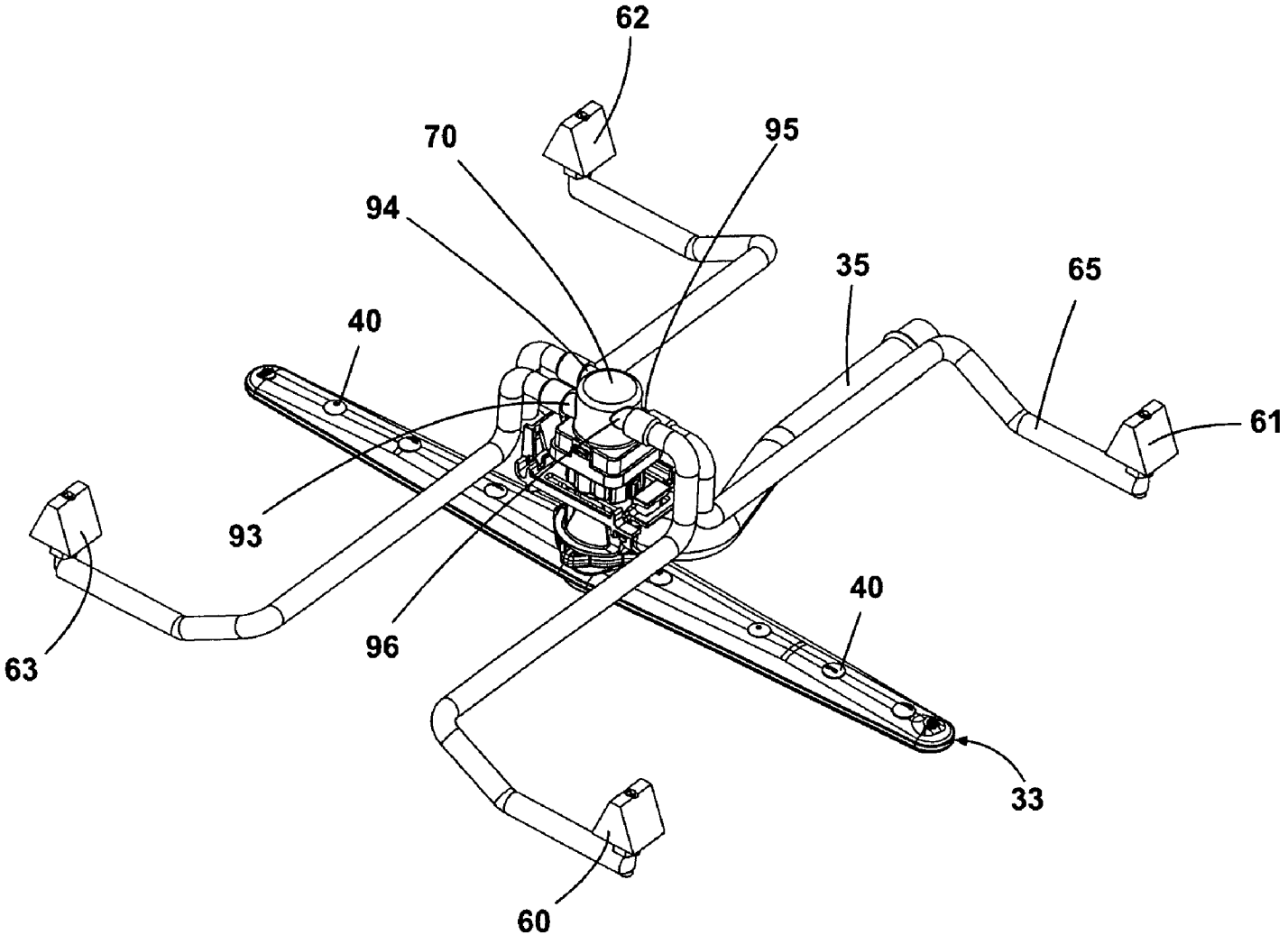
FIG. 2A is similar to FIG. 2 except that the rack has been removed to better see the spray arm, spray nozzles, and valve.

Referring now to FIGS. 2 and 2A, a spray nozzle 60 is located in a first corner of the upper utensil rack 17, a second spray nozzle 61 is located in a second corner of the upper utensil rack 17, a third spray nozzle 62 is located in a third corner of the upper utensil rack 17, and a fourth spray nozzle 63 is located in a fourth corner of the upper utensil rack 17. Each spray nozzle 60-63 may be fixed to the upper utensil rack 17 and configured to provide a second flow of wash liquid over a portion, or several portions, of the interior of the wash chamber 24. This additional liquid may create a separate wash zone or an intensified wash zone in the wash chamber 24. Each spray nozzle 60-63 may be mounted in any configuration on the upper utensil rack 17. For that matter, the invention contemplates that spray nozzles may be mounted anywhere upon the interior of the wash chamber or on the lower utensil rack 15.

Referring to FIG. 2A, a valve assembly 70 is fluidly coupled to the rotating mid-level spray arm assembly 33 and to the spray nozzles 60-63 to selectively supply fluid to the spray nozzles 60-63. Multiple conduits 65 extend from the valve assembly 70 to a corresponding one of the spray nozzles 60-63 to establish a fluid connection between the valve assembly 70 and the spray nozzles 60-63. The valve assembly is fluidly coupled to the interior of the rotating mid-level spray arm assembly 33. With the configuration, the valve assembly 70 can draw fluid supplied to the interior of the spray arm from the pump 31 and direct it to the spray nozzles 60-63. The supply of fluid from the spray arm to the spray nozzles 60-63 can be done simultaneously or sequentially. It is anticipated that it will be done consecutively to ensure fluid with sufficient pressure for cleaning is sprayed from the nozzles 60-63.

Figure 3:
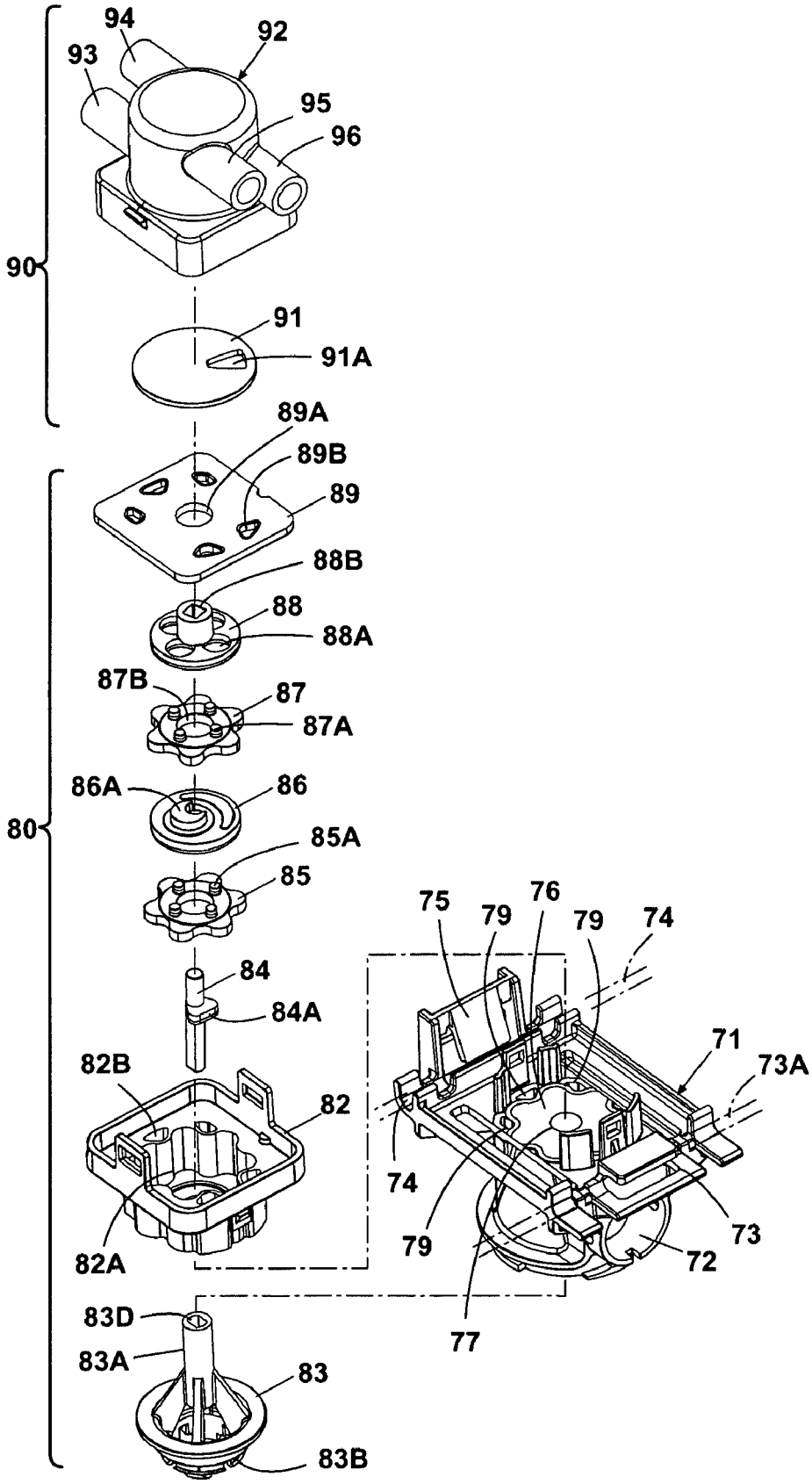
FIG. 3 is an exploded view of the valve of FIGS. 2 and 2A.

FIG. 3 is an exploded view of the parts making up the valve assembly 70. The parts can be arranged in three functional groupings: a lower mount 71, a drive assembly 80, and a water distribution unit 90. The lower mount 71 functions to attach the valve assembly 70 to the lower surface of the upper dish rack 17 and to fluidly couple the valve assembly 70 to the supply tube 35. The water distribution unit 90 operates as a manifold to distribute water coming from the supply tube 35, through the lower mount 71, to the multiple conduits 65. The drive assembly 80 drives the water distribution unit 90.

Looking at each of the functional groups in greater detail, the lower mount 71 couples to the wires forming part of the lower surface of the upper dish rack 17. The lower mount 71 has a C-shaped holder 73 and a U-shaped holder 74 that secure the valve assembly 70 to the upper dish rack 17. The C-shaped holder 73 is normally slid onto a wire 73A of the rack. The lower mount 71 is then rotated about the interface of the C-shaped holder 73 and the corresponding wire to bring the U-shaped holder into contact with the corresponding wire 74A and snap beneath spring finger 75. The lower mount 71 has a base 76 that supports the bottom of the drive assembly 80 when the valve assembly is fully assembled. The lower mount 71 has a single inlet 72, which fluidly couples the valve assembly 70 to the supply tube 35. Drive shaft opening 77 extends through the lower mount 71. Fluid passages 79 are spaced about the periphery of the lower mount 71 and are fluidly coupled to the single inlet 72 to effect the transfer of fluid through the lower mount 71 from the inlet 72.

The drive assembly 80 is composed of a gear box 82, a first drive shaft 83, a second drive shaft 84, a first gear 85, a carrier 86, a second gear 87, an output gear 88, and a gear plate 89 that all combine to form an epicyclical gear drive. The gear box 82 has a seven-sided interior recess 82A that houses a gear stack formed by the gears 85 and 87, gear chain 86, and output shaft 88. Multiple fluid passages 82B, complementary to fluid passages 79, extend through the gear box 82 and are located exteriorly of the recess 82.

Looking at the gear stack in more detail, the first gear 85 has six sides and is operably coupled to the underside of the carrier 86 through pins 85A. The carrier 86 also has a projection 86A. The projection 86A is set off center of the rotational axis of the drive shaft 84 and as the projection 86A rotates it defines an orbital path around the rotational axis of the drive shaft 84. The carrier 86 is operably coupled to the second gear 87 by the projection 86A being received within the opening 87B such that the second gear 87 tracks the orbital path made by the projection 86A. The second gear 87 also has six teeth and is operably coupled to the output gear 88 by pins 87A being received within openings 88A. The output gear 88 has an output shaft 88B for coupling to the water distribution unit 90.

The gear assembly has a 36:1 gear reduction such that a 22 to 24 rpm of the rotating mid-level spray arm assembly 33 results in a thirty-second spray time per each corner nozzle. Although the gear assembly shown is an epicyclical gear assembly; it has been contemplated that other types of gear assemblies could be used.

A seal plate 89 abuts the gear box 82 such that it closes the top of the recess 82 and seals the recess 82 and the gears inside relative to the fluid passages 82B. The seal plate 89 has a central opening 89A for passage of the output shaft 88B and openings 89B that are complementary to fluid passages 82B. The openings 89B further continue the fluid path from the supply tube 35 through the lower mount 71 and the gear box 82.

The first drive shaft 83 is received within the lower mount 71 such that it is free to rotate. It has an upper portion 83A that extends into the drive shaft opening 77 of the lower mount 71. It also has a lower portion 83B that forms a mount and is coupled to the spray arm 33 such that rotation of the spray arm 33 will rotate the first drive shaft 83. The lower portion 83B is configured such that it snaps into the rotating mid-level spray arm assembly 33 to effect the coupling therebetween. The second drive shaft 84 is inserted into an axial opening 83D in the upper portion 83A and is operably coupled to the underside of the first gear 85 by a catch 84A. In this way, the rotation of the spray arm results also rotates the drive shafts 83, 84, which in turn rotate the output shaft 88B via the gear stack at the selected reduction ratio.

The water distribution unit 90 comprises a diverter disk 91 and an upper housing 92 with four outlets 93, 94, 95, and 96. The upper housing 92 further comprises four separate sections each fluidly connected to one of the four outlets 93-96. Each of the four outlets 93-96 is fluidly coupled to a separate spray nozzle 60-63 by multiple conduits 65. The diverter disk 91 has a single hole 91A through which water may flow from the lower mount 71 and gear box 82 into one of the four separate sections of the upper housing 92. The output shaft 88, of the drive assembly 80, is operably coupled to the diverter disk 91 and operates to rotate the diverter disk 91 as the rotating mid-level spray arm assembly 33 rotates. Movement of the diverter disk 91 allows fluid coupling between wash liquid in the lower mount 71 and gear box 82 to each of the four individual sections of the upper housing 92 consecutively. Thus, the water distribution unit 90 allows for sequential fluid coupling of water in the lower mount 71 to each of the spray nozzles 60-63.

Figure 4:
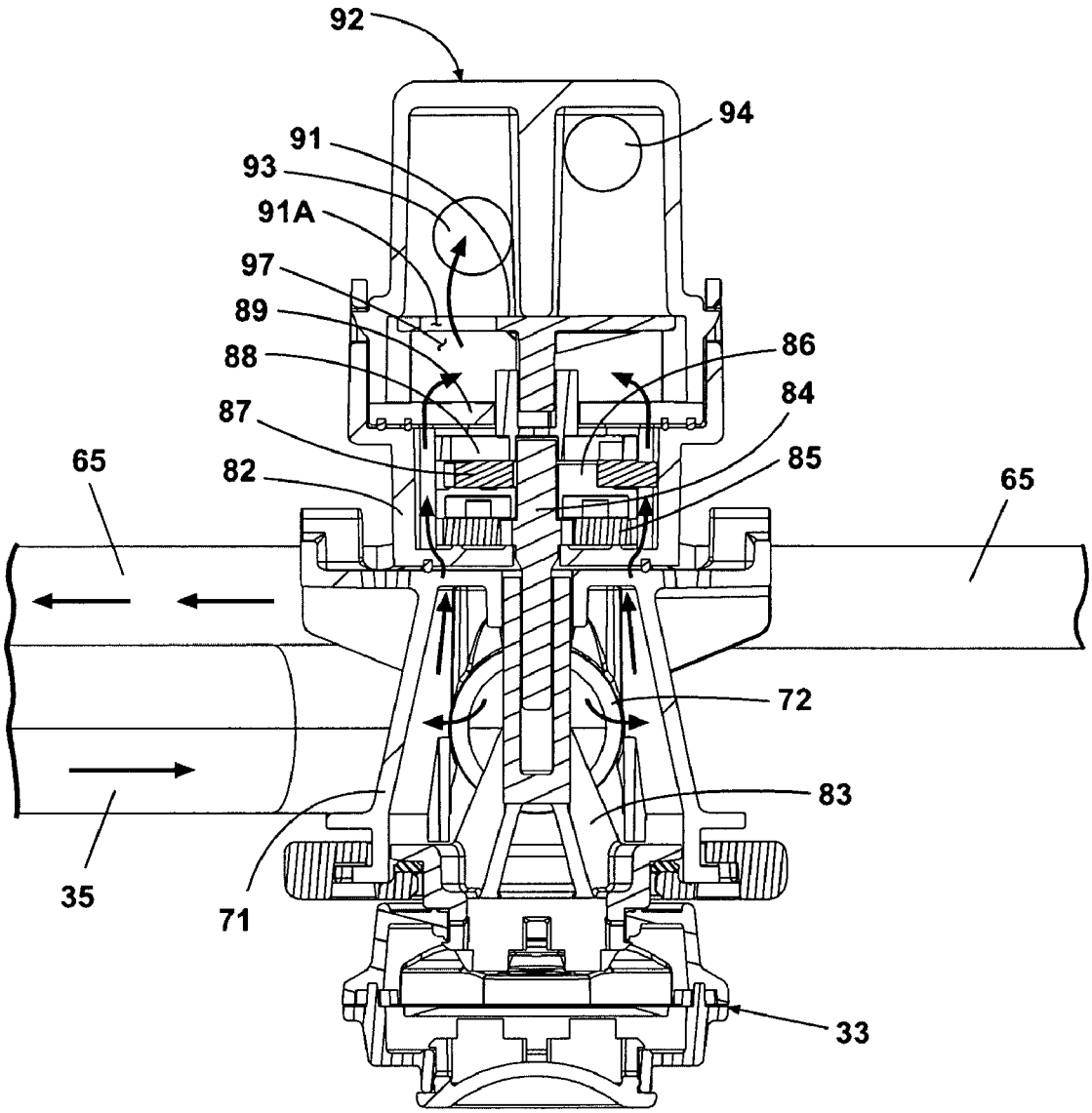
FIG. 4 is a first cut away view of the upper utensil rack of FIG. 2.
Figure 5:
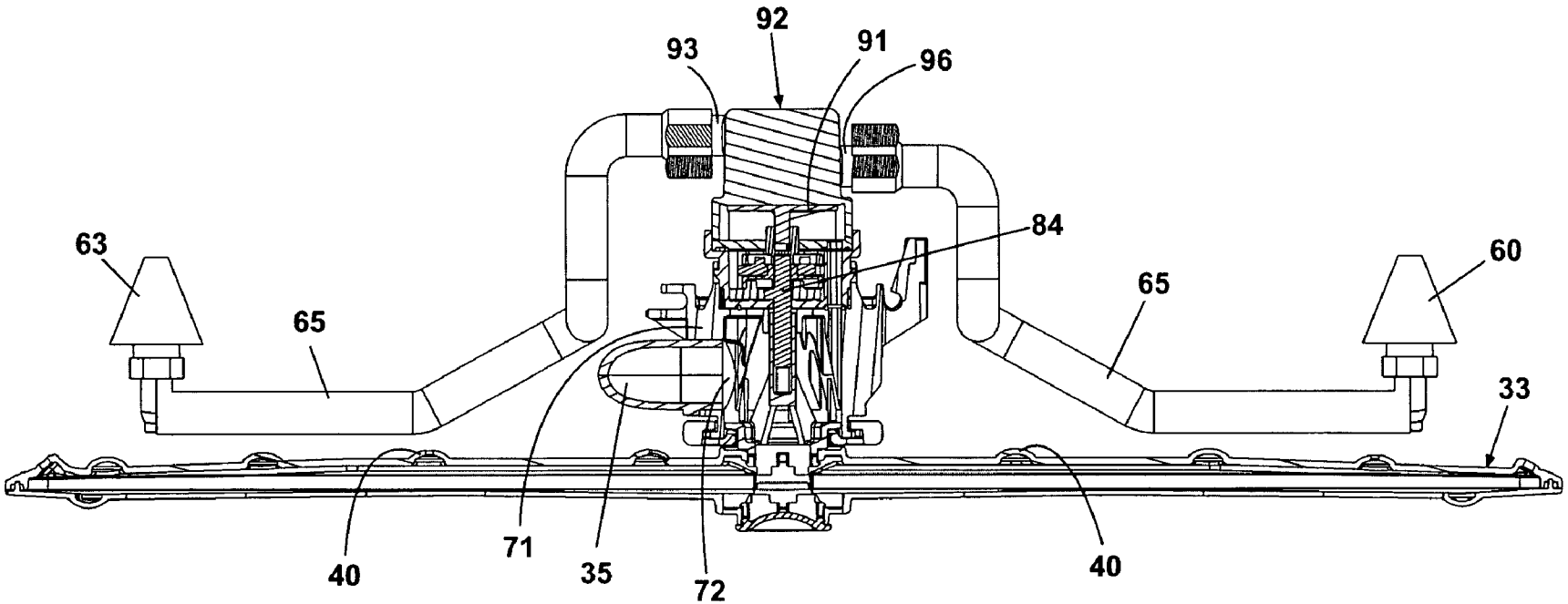
FIG. 5 is a second cut away view of the upper utensil rack of FIG. 2.

Referring to FIG. 4, when the valve assembly 70 is assembled, it provides for fluid paths, as shown by the arrows, from the supply tube 35 to the water distribution unit 90. The flow paths are formed by the complementary fluid passages 79 in the lower mount, passages 82B in the gear box 82, and openings 89A in the seal plate. These fluid paths extend from the supply tub 35 to a chamber 97 in the distribution unit 90 defined by the space between the diverter disk 91 and the seal plate 89. The opening 91A fluidly connects the chamber 97 to the corresponding outlet 93, 94, 95, and 96.

FIG. 4 also illustrates the connection of the drive assembly. The second drive shaft 84 is shown with its lower portion received within the axial opening 83D of the lower drive shaft and its upper portion extending through the gear stack and terminating in the lower portion of the portion output gear 88. In this way, the upper portion of the second drive shaft 84 aids in aligning all of the parts of the gear stack. The pins 85A are shown received in recesses in the carrier 86, which are similar to the openings 88A in the output gear 88. The lower portion 83B of the first drive shaft 83 is shown coupled to the rotating spray arm 33, which resides below the inlet 72. With this configuration, the rotation of the spray arm 33 effects the rotation of the diverter disk 91.

During operation of the dishwasher 10, the valve assembly 70 may be employed to control the volume of the stream of liquid from the rotating mid-level spray arm assembly 33 to each of the spray nozzles 60-63. When time comes to spray wash liquid into the wash chamber 24 the controller 50 signals the pump assembly 31 to supply wash liquid to the spray arm assemblies 32-34 through the supply tube 35. When the wash liquid reaches the lower mount 71 a large portion goes to the rotating mid-level spray arm assembly 33. The wash liquid sprayed from the rotating mid-level spray arm assembly 33 causes it to rotate. The rotation turns the first drive shaft 83, which in turn causes the gear assembly to move and for the diverter disk 91 to slowly turn. Movement of the diverter disk 91 rotates the opening 91A to sequentially bring it into fluid coupling with a different section of the housing 90 corresponding to each of the outlets 93-96. The amount of time that the opening 91A is in fluid coupling with each of the outlets 93-96 controls the duration of the time that each nozzle 60-63 sprays liquid. The time of fluid coupling can be thought of as a dwell time. With the described valve assembly configuration, the dwell time can be controlled by the gear reduction ratio and the flow rate of water.

It should be noted that the supply tube 35 feeds water to both the rotating mid-level spray arm assembly 33 and the valve assembly 70. Thus, the valve assembly 70 is actually diverting a small amount of the water intended for the rotating mid-level spray arm assembly 33. The valve assembly 70 only diverts a portion of the wash liquid from the rotating mid-level spray arm assembly 33 because if too much wash liquid is diverted the rotating mid-level spray arm assembly 33 will stop rotating. For the illustrated configuration, the liquid flow rate sufficient to cause the spray arm to rotate at a steady rate and overcome the inherent resistance of the valve assembly is a flow rate that results in a rotational rate of the spray arm of at least around 17 rpm.

Further, it has been contemplated that the invention may differ from the configuration shown in FIGS. 1-5, such as by inclusion of other conduits, utensil racks, valves, spray nozzles, and the like, to control the flow of the stream of wash liquid.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic dishwasher comprising:

a housing defining a wash chamber having multiple corners;

a rotatable spray arm having a plurality of outlets and mounted within the wash chamber for rotation about an axis such that liquid supplied to the rotatable spray arm exits the outlets to provide a first wash zone that rotates with the rotatable spray arm;

a liquid supply fluidly connected to the rotatable spray arm to provide liquid to the rotatable spray arm;

at least one spray nozzle fixedly located within the wash chamber relative to at least one of the multiple corners and physically spaced from the rotatable spray arm to provide a second wash zone of liquid within the chamber; and a valve fluidly coupling the liquid supply to the at least one spray nozzle and moveable between an open position, where the valve permits a flow of liquid to the at least one spray nozzle, and a closed position, where the valve prohibits a flow of liquid to the at least one spray nozzle;

wherein the valve is operably coupled to the rotatable spray arm such that continued rotation of the spray arm repeatedly moves the valve between the opened and closed positions to selectively supply liquid from the liquid supply to the at least one spray nozzle while the rotatable spray arm sprays liquid from the liquid supply within the wash chamber.

2. The automatic dishwasher according to claim 1, further comprising a utensil rack located within the wash chamber wherein the at least one spray nozzle, the valve, and the rotating spray arm are carried by the utensil rack.

3. The automatic dishwasher according to claim 2, wherein the utensil rack comprises a bottom and a side defining at least one corner wherein the rotating spray arm is mounted to a bottom and the at least one spray nozzle is mounted in the at least one corner.

4. The automatic dishwasher according to claim 3, wherein the utensil rack defines multiple corners and the at least one spray nozzle comprises a spray nozzle located in each corner.

5. The automatic dishwasher according to claim 4, wherein the valve selectively fluidly couples each of the spray nozzles to the liquid supply in response to the rotation of the rotating spray arm.

6. The automatic dishwasher according to claim 5, wherein the valve sequentially fluidly couples each of the spray nozzles to the liquid supply in response to the rotation of the rotating spray arm.

7. The automatic dishwasher according to claim 2, further comprising a manifold mounted to the utensil rack and fluidly coupled to the liquid supply, rotating spray arm, and at least one spray nozzle to distribute liquid from the liquid supply to the rotating spray arm and the at least one nozzle.

8. The automatic dishwasher according to claim 7, wherein the valve is located within the manifold to control the flow of liquid from the liquid supply to the at least one spray nozzle.

9. The automatic dishwasher according to claim 8, wherein the rotating spray arm is rotatably mounted to the manifold and is directly fluidly coupled to the liquid supply.

10. The automatic dishwasher according to claim 9, wherein the valve comprises a moveable valve body having at least one open position.

11. The automatic dishwasher according to claim 10, further comprising a drive shaft operably coupled to the moveable valve body and the rotating spray arm such that rotation of the rotating spray arm rotates the drive shaft to selectively move the valve body into the at least one open position.

12. The automatic dishwasher according to claim 11, further comprising a reduction gear assembly operably coupling the drive shaft to the moveable valve body.

13. The automatic dishwasher according to claim 12, wherein the reduction gear assembly comprises an epicyclical gear chain.

14. The automatic dishwasher according to claim 12, wherein the reduction gear assembly provides approximately a 36:1 gear reduction.

15. The automatic dishwasher according to claim 14, wherein the rotating spray arm is rotated at least 20 rpm.

16. The automatic dishwasher according to claim 15, wherein the rotating spray arm is rotated within the range of 22 to 24 rpm.

17. The automatic dishwasher according to claim 11, and further comprising multiple spray nozzles and the valve body having open positions, one open position for each of the spray nozzles, wherein rotation of the rotating spray arm sequentially moves the valve body through the open positions to selectively couple the liquid supply to the spray nozzles.

18. The automatic dishwasher according to claim 17, wherein the utensil rack has multiple corners and at least one of the multiple spray nozzles is located in each of the multiple corners.

19. The automatic dishwasher according to claim 18, further comprising a conduit fluidly coupling the manifold to each of the multiple spray nozzles.

20. The automatic dishwasher according to claim 19, wherein there is a conduit for each of the spray nozzles.

21. The automatic dishwasher of claim 1 wherein the first and second wash zones intersect.

22. An automatic dishwasher comprising:

a housing defining a wash chamber;

a utensil rack having multiple corners;

at least one spray nozzle fixedly located within the wash chamber relative to at least one of the multiple corners to spray liquid into the at least one of the multiple corners;

a valve selectively actuable to fluidly couple the at least one spray nozzle to a liquid supply; and a rotating spray arm positioned within the wash chamber and physically spaced from the at least one spray nozzle, the rotating spray arm having a plurality of outlets fluidly coupled to the liquid supply to spray liquid within the chamber;

wherein the rotating spray arm is mechanically coupled to the valve such that rotation of the spray arm selectively actuates the valve and controls a supply of liquid from the liquid supply to the at least one spray nozzle to spray liquid into the at least one of the multiple corners.

23. The automatic dishwasher according to claim 22, wherein the valve comprises a moveable valve body having at least one open position.

24. The automatic dishwasher according to claim 23, further comprising a drive shaft operably coupled to the moveable valve body and the rotating spray arm such that rotation of the rotating spray arm rotates the drive shaft to selectively move the valve body into the at least one open position.

25. The automatic dishwasher according to claim 24, further comprising a reduction gear assembly operably coupling the drive shaft to the moveable valve body.

26. The automatic dishwasher according to claim 22, wherein the at least one spray nozzle comprises multiple spray nozzles.

27. The automatic dishwasher according to claim 26, wherein at least one of the multiple spray nozzles is located in each of the multiple corners.

28. The automatic dishwasher according to claim 26, wherein the multiple spray nozzles are fixedly mounted to the rack.

29. The automatic dishwasher according to claim 26, wherein the valve sequentially fluidly couples each of the multiple spray nozzles to the liquid supply to control the supply of liquid from the liquid supply to the multiple spray nozzles to sequentially spray liquid into the multiple corners.

* * * * *